US010036532B2

(12) United States Patent
Shih

(10) Patent No.: US 10,036,532 B2
(45) Date of Patent: Jul. 31, 2018

(54) LIGHT REFLECTION COVER

(71) Applicant: NIKEN VEHICLE LIGHTING CO., LTD., Changhua County (TW)

(72) Inventor: Shou-Jen Shih, Changhua County (TW)

(73) Assignee: NIKEN VEHICLE LIGHTING CO., LTD., Changhua County (TW)

( * ) Notice: Subject to any disclaimer, the term of this patent is extended or adjusted under 35 U.S.C. 154(b) by 0 days.

(21) Appl. No.: 15/615,835

(22) Filed: Jun. 7, 2017

(65) Prior Publication Data

US 2018/0017231 A1 Jan. 18, 2018

(30) Foreign Application Priority Data

Jul. 13, 2016 (TW) ..... 105210541 U

(51) Int. Cl.
*F21V 7/00* (2006.01)
*F21K 9/68* (2016.01)
*F21V 7/04* (2006.01)

(52) U.S. Cl.
CPC ..... *F21V 7/0083* (2013.01); *F21K 9/68* (2016.08); *F21V 7/04* (2013.01)

(58) Field of Classification Search
USPC ..... 362/341, 249.02, 347, 350
See application file for complete search history.

(56) References Cited

U.S. PATENT DOCUMENTS 8,231,244 B2 * 7/2012 He ..... F21V 7/00 362/241
8,240,879 B2 * 8/2012 Hsu ..... F21V 7/04 362/240
9,188,309 B2 * 11/2015 Wang ..... G02F 1/133603

* cited by examiner

*Primary Examiner* — Vip Patel
(74) *Attorney, Agent, or Firm* — Leong C. Lei

(57) ABSTRACT

A light reflection cover includes a reflection compartment and rhombus blocks. The reflection compartment includes a first surface and a second surface opposite to each other, a first reflection surface connected between rear portions of the first and second surfaces, an opening formed between front portions of the first and second surfaces to provide communication between inside and outside. The rhombus blocks are arranged in a row on the second surface and distributed along the opening and spaced from each other. A top of each rhombus block forms an apex area having two sides defining therebetween an angle of 120 degrees; and bottoms of two adjacent rhombus blocks collectively form a valley are having an angle of 120 degrees between the bottoms. A second reflection surface is formed on a front side of each rhombus block and connects between the apex area and the valley area.

8 Claims, 3 Drawing Sheets

LIGHT REFLECTION COVER

TECHNICAL FIELD OF THE INVENTION

The present invention relates generally to a light reflection cover that provides improved lighting performance.

DESCRIPTION OF THE PRIOR ART

A conventional light reflection cover, as shown in FIGS. 1 and 2, comprises a semicircular concave arc surface 91, an opening 92 through which the concave arc surface 91 projects light outward. A row of equally spaced light-emitting diodes 93 are mounted on the concave arc surface 91 adjacent to an edge of the opening 92. The light-emitting diodes 93 emit light toward concave arc surface 91 and an opposite edge of the opening 92 to have the light projected outward through the opening 92.

As shown in FIG. 2, the light-emitting diodes 93 each give off light in an angular range of 120 degrees toward concave arc surface 91. Consequently, dark zones "A" are formed on two sides of each of the light-emitting diodes 93 and out-of-focus zones "B", where light from two adjacent ones of the light-emitting diodes 93 cast together in an overlapping form, are formed above the dark zones "A" such that blurring might occur in the out-of-focus zones "B".

Thus, in the above-described conventional light reflection cover, the projection of light from the light-emitting diodes 93 may generate the dark zones "A" and the out-of-focus zones "B", and this leads to poor lighting performance. This is a drawback that has not been overcome before by the known devices and techniques.

In view of this, the present invention aims to provide a technical solution that helps alleviate the drawbacks of the conventional light reflection cover.

SUMMARY OF THE INVENTION

The present invention provides a light reflection cover, which comprises, at least:

- a reflection compartment, which comprises a first surface and a second surface that are respectively set at upper and lower sides and are opposite to each other, a first reflection surface connected between rear portions of the first surface and the second surface, and an opening formed between front portions of the first surface and the second surface and providing communication between inside and outside; and
- a plurality of rhombus blocks, which are arranged in a line and project upward from the second surface, and are distributed along the opening and spaced from each other by a fixed spacing distance, wherein a top of each of the rhombus blocks forms an apex area having two sides defining an angle of 120 degrees therebetween and bottoms of two adjacent ones of the rhombus blocks collectively form a valley area having an angle of 120 degrees defined between the bottoms, a second reflection surface is formed on a front side of each of the rhombus blocks and connects between the apex area and the valley areas associated with block; and wherein an upper light-emitting diode is mounted to the first surface at a location corresponding to the apex area and a lower light-emitting diode is mounted to the second surface at a location corresponding to the valley area.

As such, the present invention is structured such that the apex areas of the rhombus blocks guide light emitting from the upper light-emitting diode, while the valley areas of the rhombus blocks guide light emitting from the lower light-emitting diode; and the second reflection surfaces function to project outward light from the upper light-emitting diodes and the first reflection surface functions to project outward light from the lower light-emitting diodes to be complementary to each other to eliminate a dark zone and an out-of-focus zone that occur in a conventional device, thereby showing an improved visual effect of light reflection providing improved lighting performance.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
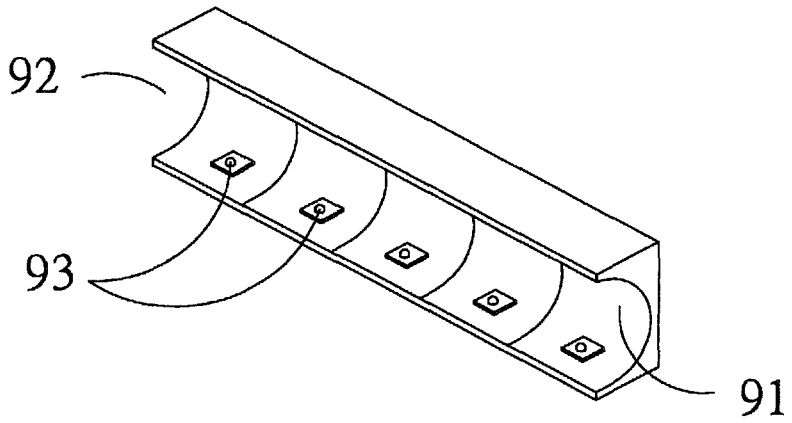
PRIOR ART FIG. 1
FIG. 1 is a schematic view illustrating a conventional light reflection cover.
Figure 2:
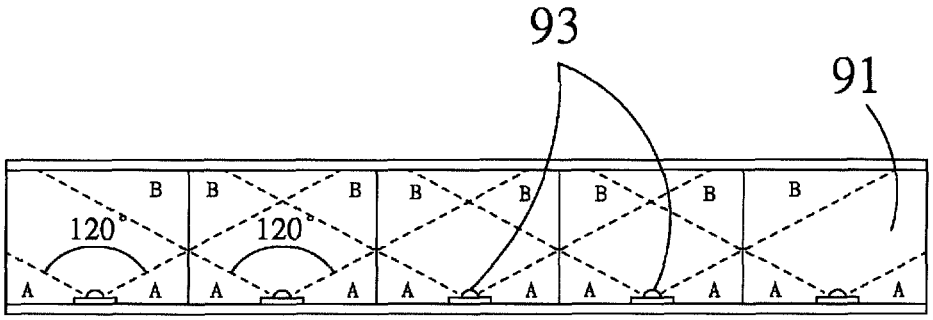
PRIOR ART FIG. 2
FIG. 2 is a front view illustrating the conventional light reflection cover.
Figure 3:
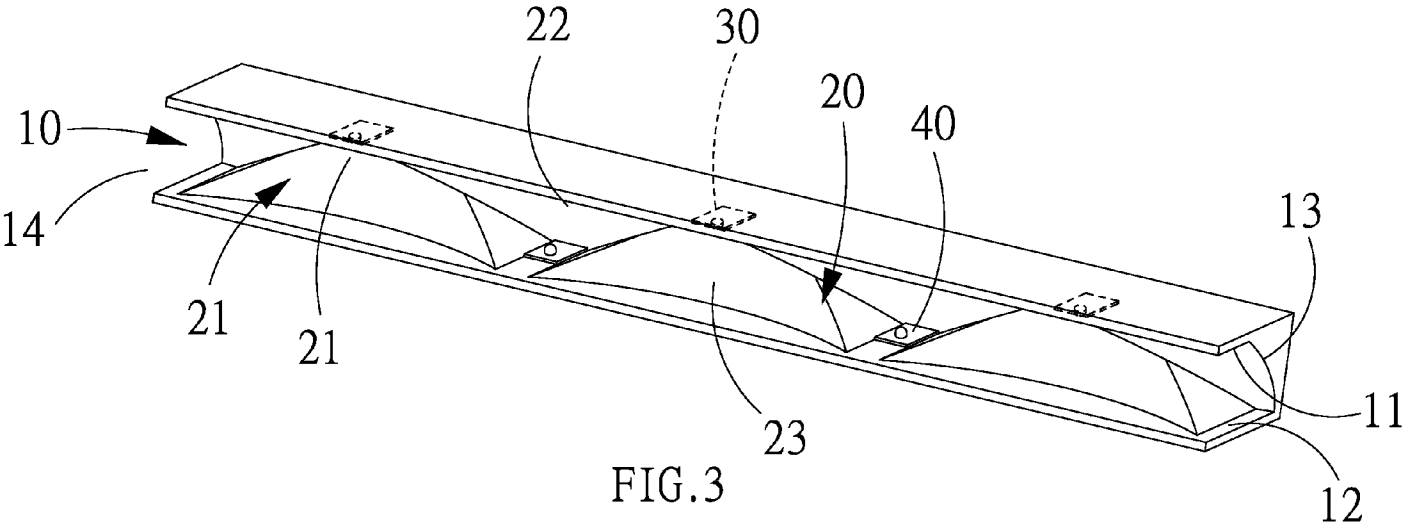
FIG. 3 is a perspective view illustrating a light reflection cover according to the present invention.
Figure 4:
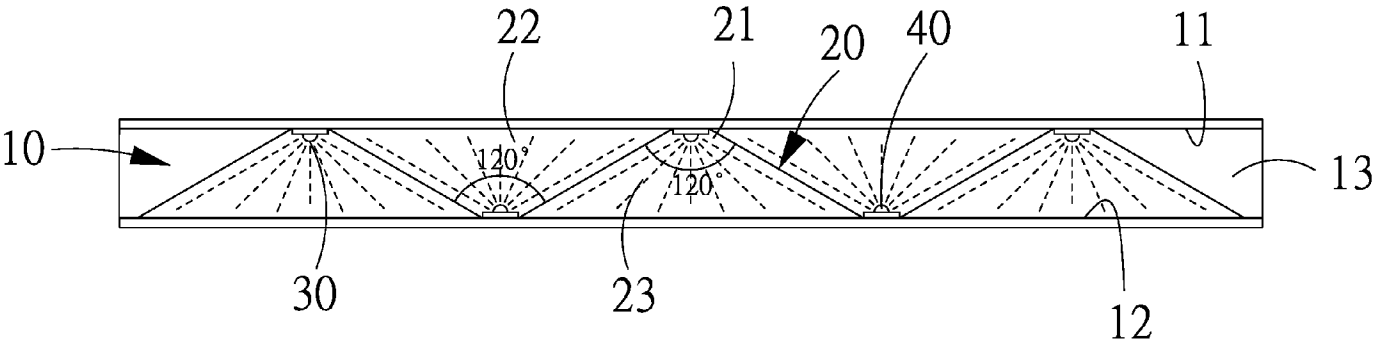
FIG. 4 is a front view of the light reflection cover according to the present invention.
Figure 5:
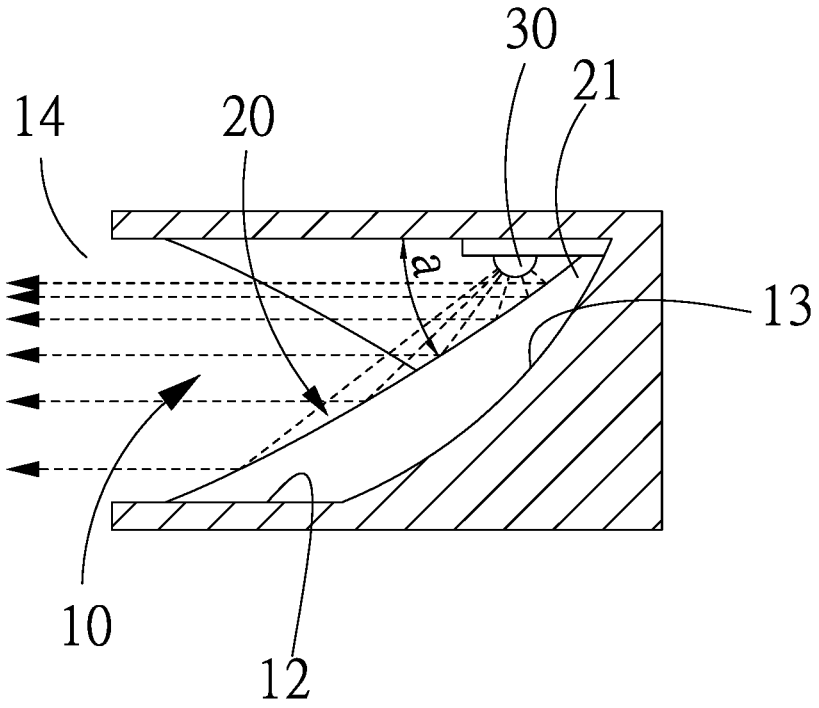
FIG. 5 is a schematic view illustrating light exiting from the light reflection cover according to the present invention.

Referring to FIGS. 3-5, the present invention provides a light reflection cover, which comprises, at least:

- a reflection compartment 10, which comprises a first surface 11 and a second surface 12 that are respectively set at upper and lower sides and are opposite to and substantially parallel with each other, wherein a first reflection surface 13 that comprises a concave arc configuration in a sector form is connected between rear portions of the first surface 11 and the second surface 12 and an opening 14 that is formed between front portions of the first surface 11 and the second surface 12 and provides communication between inside and outside is provided to allow light to be projected outward by the first reflection surface 13; and
- a plurality of rhombus blocks 20, which are arranged in a line and project upward from the second surface 12, wherein the rhombus blocks 20 are arranged to distribute along the opening 14 and are spaced from each other by a fixed spacing distance and wherein a top of each of the rhombus blocks 20 forms an apex area 21 having two sides defining an angle of 120 degrees therebetween and bottoms of two adjacent ones of the rhombus blocks 20 collectively form a valley area 22 having an angle of 120 degrees between the bottoms of the two blocks, and further, each of the rhombus blocks 20 has a front side forming a second reflection surface 23 connecting the apex area 21 and the valley areas 22 associated with the block, the second reflection surface 23 being in the form of a slope that defines, with respect to the first surface 11, an included angle "a" to provide a configuration of being increasingly divergent in a direction toward the opening 14; wherein an upper light-emitting diode 30 is arranged on the first surface 11 at a location corresponding to each of the apex areas 21 and a lower light-emitting diode 40 is arranged on the second surface 12 at a location corresponding to each of the valley areas 22.

It can be understood from the above description that in the present invention, the apex areas 21 of the rhombus blocks 20 each guide light emitting from the associated upper light-emitting diode 30, while the valley areas 22 of the rhombus blocks 20 each guide light emitting from the associated lower light-emitting diode 40; and the second reflection surfaces 23 function to project outward light from the upper light-emitting diodes 30 and the first reflection surface 13 functions to project outward light from the lower light-emitting diodes 40 to be complementary to each other to eliminate a dark zone and an out-of-focus zone that occur in a conventional device, allowing the exiting light of the present invention to show an improved visual effect of light reflection providing improved lighting performance.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A light reflection cover, comprising, at least:

a reflection compartment, which comprises a first surface and a second surface that are respectively set at upper and lower sides and are opposite to each other, a first reflection surface connected between rear portions of the first surface and the second surface, and an opening formed between front portions of the first surface and the second surface and providing communication between inside and outside; and a plurality of rhombus blocks, which are arranged in a line and project upward from the second surface, and are distributed along the opening and spaced from each other by a fixed spacing distance, wherein a top of each of the rhombus blocks forms an apex area having two sides defining an angle therebetween and bottoms of two adjacent ones of the rhombus blocks collectively form a valley area having an angle defined between the bottoms, a second reflection surface is formed on a front side of each of the rhombus blocks and connects between the apex area and the valley areas associated with block.

2. The light reflection cover according to claim 1, wherein the top of each of the rhombus blocks forms the apex area having the angle of 120 degrees and the bottoms of the two adjacent ones of the rhombus blocks collectively form the valley area having the angle of 120 degrees.

3. The light reflection cover according to claim 1, wherein the second reflection surface is in the form of a slope that defines, with respect to the first surface, an included angle providing a configuration of being increasingly divergent in a direction toward the opening.

4. The light reflection cover according to claim 3, wherein the first surface and the second surface are arranged parallel to each other and the first reflection surface comprises a concave arc configuration in a sector form.

5. The light reflection cover according to claim 1 further comprising an upper light-emitting diode mounted to the first surface at a location corresponding to the apex area and a lower light-emitting diode mounted to the second surface at a location corresponding to the valley area, wherein the apex area guides light from the upper light-emitting diode and the valley area guides light from the lower light-emitting diode and wherein the second reflection surface projects the light from the upper light-emitting diode outward and the first reflection surface projects light from the lower light-emitting diode outward.

6. The light reflection cover according to claim 2 further comprising an upper light-emitting diode mounted to the first surface at a location corresponding to the apex area and a lower light-emitting diode mounted to the second surface at a location corresponding to the valley area, wherein the apex area guides light from the upper light-emitting diode and the valley area guides light from the lower light-emitting diode and wherein the second reflection surface projects the light from the upper light-emitting diode outward and the first reflection surface projects light from the lower light-emitting diode outward.

7. The light reflection cover according to claim 3 further comprising an upper light-emitting diode mounted to the first surface at a location corresponding to the apex area and a lower light-emitting diode mounted to the second surface at a location corresponding to the valley area, wherein the apex area guides light from the upper light-emitting diode and the valley area guides light from the lower light-emitting diode and wherein the second reflection surface projects the light from the upper light-emitting diode outward and the first reflection surface projects light from the lower light-emitting diode outward.

8. The light reflection cover according to claim 4 further comprising an upper light-emitting diode mounted to the first surface at a location corresponding to the apex area and a lower light-emitting diode mounted to the second surface at a location corresponding to the valley area, wherein the apex area guides light from the upper light-emitting diode and the valley area guides light from the lower light-emitting diode and wherein the second reflection surface projects the light from the upper light-emitting diode outward and the first reflection surface projects light from the lower light-emitting diode outward.

* * * * *